United States Patent [19]

Akimoto

[11] Patent Number: 4,997,027

[45] Date of Patent: Mar. 5, 1991

[54] PRESSING MECHANISM FOR CASTING APPARATUS

[75] Inventor: Haruo Akimoto, Yamaguchi, Japan

[73] Assignee: Ube Industries, Ltd., Ube, Japan

[21] Appl. No.: 350,237

[22] Filed: May 11, 1989

[30] Foreign Application Priority Data

Jun. 10, 1988 [JP] Japan ..... 63-141471

[51] Int. Cl.[5] ..... B22D 17/00

[52] U.S. Cl. ..... 164/312; 164/321

[58] Field of Search ..... 164/120, 312, 319, 321

[56] References Cited

U.S. PATENT DOCUMENTS 4,860,818 8/1989 Dannoura ..... 164/312

FOREIGN PATENT DOCUMENTS 474980 7/1951 Canada ..... 164/120
312305 8/1952 France ..... 164/120
44-29055 12/1969 Japan .
44-31325 12/1969 Japan .
47-18975 5/1972 Japan .
51-34809 9/1976 Japan .
58-55858 12/1983 Japan .
59-13492 4/1984 Japan .
59-30503 7/1984 Japan .
60-2947 1/1985 Japan .

*Primary Examiner*—Richard K. Seidel
*Assistant Examiner*—Edward A. Brown
*Attorney, Agent, or Firm*—Kanesaka and Takeuchi

[57] ABSTRACT

A pressing mechanism for a casting apparatus comprising: a mold including a cavity for solidifying molten metal therein and a passage for introducing the molten metal into the cavity; a unit for supplying molten metal into the passage, the unit having a sleeve to store molten metal and capable of communicating with the passage and a plunger tip in the sleeve, the plunger tip being capable of protruding from the sleeve so that the molten metal is fed into the mold after the sleeve is communicated with the passage, the tip being capable of protruding substantially completely into the passage so that a front end of the tip approaches closely to a part of an internal surface of the passage; a feeding rod disposed in the mold for freely protruding into the passage; a unit for reciprocating the feeding rod; first and second grooves, the first groove being provided on the part of the inner surface of the passage, the second groove being provided on the front end so that the first and second grooves form a hole into which the feeding rod is protruded after the molten metal is filled in the mold. The feeding rod is actuated to compress the molten metal in the mold.

5 Claims, 4 Drawing Sheets

PRESSING MECHANISM FOR CASTING APPARATUS

FIELD OF THE INVENTION AND RELATED ART STATEMENT

The present invention relates to a casting apparatus such as a diecasting machine accompanied by the injection of molten metal for casting metal and, more particularly, to a casting apparatus having its metal feeding unit improved.

In a casting apparatus such as a diecasting machine, the molten metal is fed from a pouring unit through a biscuit portion and runner of a mold unit to a cavity, in which it is solidified into a molding.

If this molding is made for a pressure-resistive article to be made without a cavity, the cavity is pushed directly with a feeding rod after the end of the charge of the molten metal to afford the feeding effect so as to crush or disperse the cavity. This feeding effect can also be given by making the injection plunger tip of a double construction composed of an outer tip and an inner tip.

This diecasting machine is disclosed in Japanese Patent Publication Nos. 59-13492, 58-55858, 59- 30503, 60-2947, 44-31325, 47-18975 and 51-34809 and Japanese Utility Model Publication No. 44-29055. In case the cavity is to be crushed directly with the feeding rod, if the molten metal in the cavity is not solidified, the injection plunger is pushed back by the displacement of the feeding rod, so that the feeding effect cannot be given. If, on the other hand, the pushing timing is late for the direct push of the cavity, the molten metal is solidified so that the feeding rod cannot be pushed even by a considerable force. Even if pushing can be made the molding is cracked to become defective.

In case, on the other hand, the cavity is directly pushed, the timing for starting the advance of the feeding rod has to be changed due to the condition that the mold is in a relatively cold state at the start of the casting operation or the mold is in a relatively high temperature after a series of continuous casting operations. This makes it difficult to stably provide an excellent molding because the diecasting machine having a feeding rod for directly pushing the cavity is remarkably complex to operate.

In the diecasting machine having the feeding rod for the direct push of the cavity, moreover, the product is partially pushed by the feeding rod, so that it has to be machined more than necessary.

In the diecasting machine for giving the feeding effect by the double construction of the plunger tip formed of the inner and outer tips, on the other hand, the outer tip is retracted by the displacement of the advance of the inner tip to give no feeding effect if the inner tip is protruded at an early stage after the end of the charge of the molten metal, because the molten metal is not solidified to a proper level. Since, moreover, the inner tip slides on the inner circumference of the outer tip, the plunger tip has to be sufficiently cooled for preventing the seizure. For protecting the cooling portion, the plunger tip diameter have to be increased more than necessary, so that the cost for constructing the apparatus rises for nothing.

In case molten metal in a runner portion is pushed by a feeding rod to press molten metal in a cavity portion, the runner portion is required to be long enough to be projected thereinto by the feeding rod, so that the volume of the runner portion becomes larger to reduce a yield rate of the metal.

OBJECT AND SUMMARY OF THE INVENTION

The present invention has an object to provide a casting apparatus which can afford the feeding effect reliably no matter what the state of the molten metal in the mold might be. Another object of the present invention is to provide a casting machine which can make a casting of excellent quality.

A further object of the present invention is to provide a casting apparatus in which solidified metal in a cavity, a runner and a biscuit portion is made integral so that it can be easily taken out from the mold.

A further object of the present invention is to provide a casting apparatus which can make a flawless product because what is pushed by the feeding rod is a portion outside the product. A further object of the present invention is to provide a casting apparatus which can be operated under a low casting pressure, so that it can be constructed at a low cost because the feeding effect is only required for charging the cavity.

According to the present invention, there is provided a pressing mechanism of a casting apparatus comprising: a mold including a cavity for solidifying molten metal therein and a passage for introducing the molten metal therethrough into the cavity; a unit for supplying molten metal into the passage, the unit having a sleeve to store molten metal and capable of communicating to the passage and a plunger tip in the sleeve, the plunger tip being capable of protruding from the sleeve so that the molten metal is fed into the mold after the sleeve is communicated with the passage, the plunger tip being capable of protruding into the passage fully so that a front end of the plunger tip approaches closely to a part of an internal surface of the passage; a feeding rod disposed in the mold for freely protruding into the passage; a unit for reciprocating the feeding rod; first and second grooves, the first groove being provided on a part of the inner surface of the passage, the second groove being provided on the front end so that the first and second grooves form a hole where the feeding rod is protruded thereinto to compress the molten metal in the cavity after the mold is filled with the molten metal.

In the present mechanism, after the cavity and the passage have been charged up with the molten metal by moving the plunger tip, the feeding rod is pushed into the passage to afford the feeding effect. When the feeding rod is projected after the plunger tip has been moved fully, then the feeding rod is brought into a hole formed by the groove portions. The feeding rod projected occupies a part of the passage to thereby reduce the volume of the passage since the rod occupies the hole. Accordingly, the mass of metal solidified in the passage is reduced so that a yield rate of metal is enhanced. Furthermore, since the volume of the passage is reduced, molten metal in the cavity is pressed with higher pressure and afforded more feeding according to the mechanism of the invention than to that of prior art.

PREFERRED EMBODIMENTS

Figure 1:
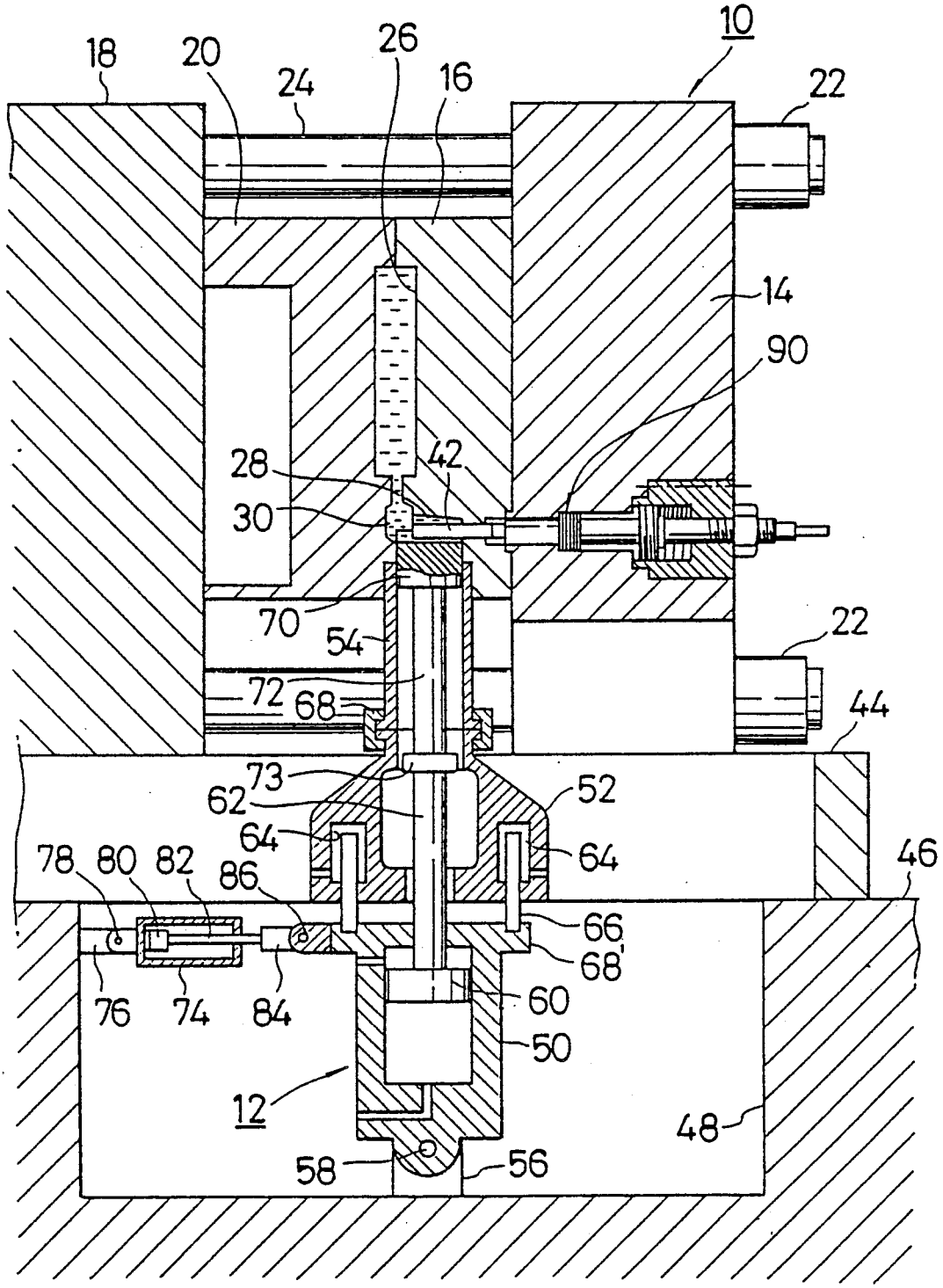
FIG. 1 is a vertical section showing a casting apparatus according to an embodiment of the present invention.
Figure 2:
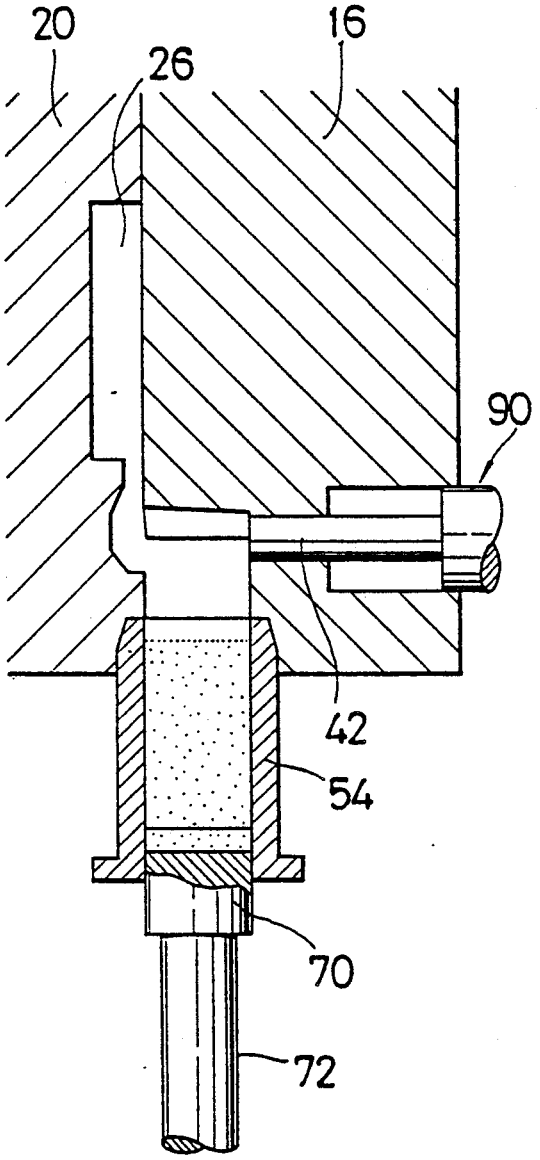
FIGS. 2, 3 and 4 are views for explaining the operations of the casting apparatus of FIG. 1.
Figure 3:
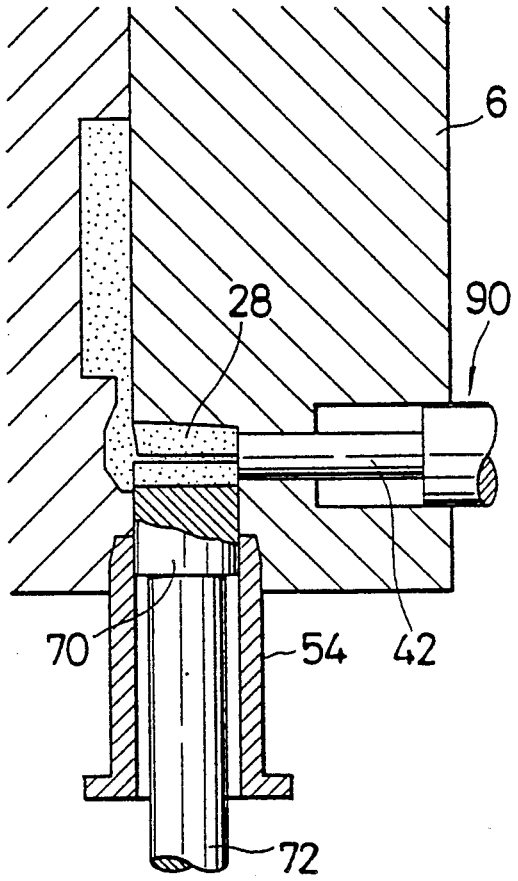

The present invention will be described in detail in the following in connection with the embodiments thereof with reference to the accompanying drawings.

A casting apparatus according to an embodiment of the present invention is constructed mainly of a molding unit 10 and a pouring unit 12. The molding unit 10 is equipped with a stationary mold 16 held on a stationary board 14 and a movable mold 20 held on a movable board 18. The stationary board 14 has a column 24 connected thereto through nuts 22, and the movable board 18 is made movable toward and apart from the stationary board 14 along the column 24 by the action of a not-shown toggle mechanism.

The stationary mold 16 and the movable mold 20 form in their mating faces a cavity 26, a biscuit 30 and a path 28 formed between the mold 16 and a plunger tip 70 so that a pressure feeding rod 42 may project thereinto.

A cylinder apparatus 90 is provided on the board 14 to advance the rod 42 into the path and withdraw therefrom.

The molding unit 10 is placed on a machine base 44, which in turn is disposed to cross a pit 48 formed by recessing a ground base 46.

The pouring unit 12 is disposed in the pit 48. This pouring unit 12 is constructed of an injection cylinder 50, a block 52 and a sleeve 54 sequentially located upward in the recited order. The injection cylinder 50 is hinged through a pin 58 to a seat 56, which is anchored to the bottom of the pit 48, so that its upper end can be inclined on the pin 58. In the injection cylinder 50, there is reciprocated a piston 60 to which is connected an upwardly extending rod 62.

The block 52 is formed with vertically extending cylinder bores 64, into which are inserted docking rams 66 having their lower ends anchored to a flange 68' formed on the top surface of the injection cylinder 50.

Figure 4:
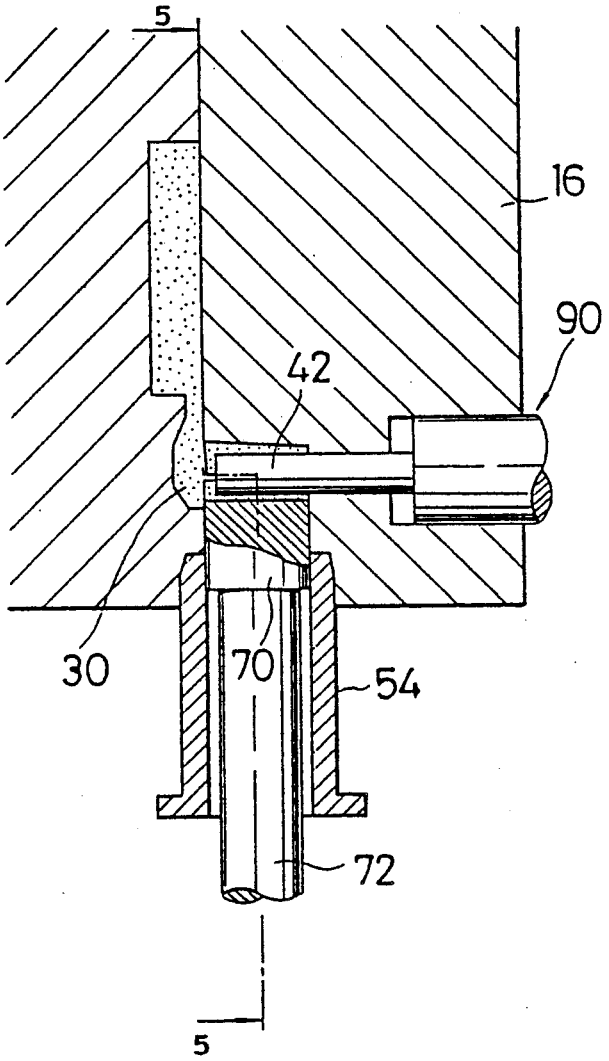
Figure 5:
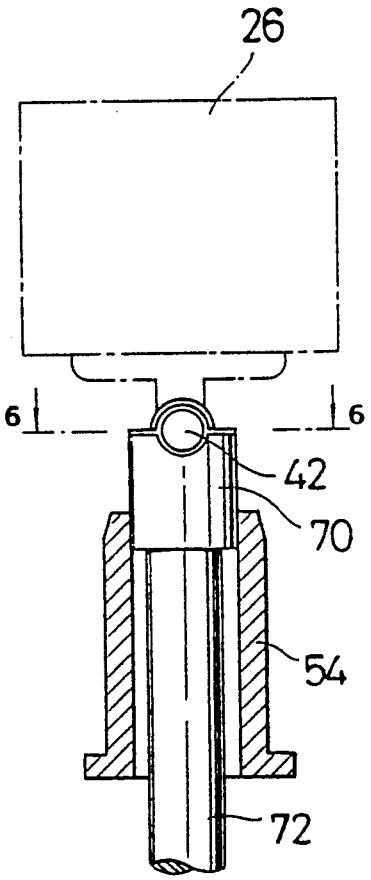
FIG. 5 is a sectional view taken along a line 5—5 in FIG. 4.
Figure 6:
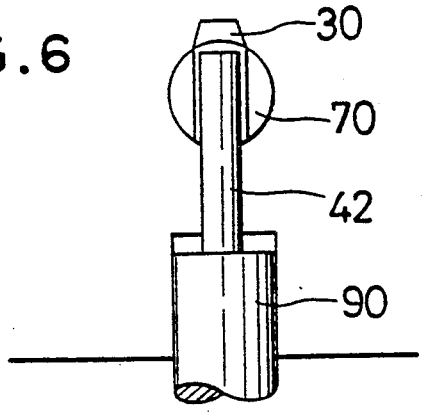
FIG. 6 is a sectional view taken along a line 6—6 in FIG. 5.

The sleeve 54 is connected through a connecting member 68 to the upper side of the block 52 and has its upper end fitted in the lower end of the biscuit 30 of the molding unit 10. The plunger tip 70 is set slidably in the sleeve 54 so that it may move up and down. A channel portion is formed on the top of the plunger tip 70 where the feeding rod 42 is moved thereinto while being projected when the tip has been moved uppermost as described in FIGS. 4 and 5. A plunger 72 which holds the plunger tip 70 is connected at its lower end to the upper end of the rod 62 through a coupling 73.

To the side wall of the pit 48, there is hinged through a seat 76 and a pin 78 an inclining cylinder 74 which has its piston 80 connected to a rod 82. This rod 82 has its leading end hinged to the side of the flange 68' of the injection cylinder 50 through a coupling 84 and a pin 86.

The operations of the casting apparatus thus constructed will be described in the following.

When oil pressure is released from the cylinder bores 64, the block 52 drops until it seats upon the cylinder 50. When, on the other hand, the oil pressure is released from the head end of the injection cylinder 50, the piston 60 drops together with the plunger tip 70 to their lower limits. If in this position, the rod 82 of the inclining cylinder 74 is protruded, the pouring unit 12 is inclined in its entirety. Then, a molten metal is poured into the sleeve 54.

After this, the rod 82 of the inclining cylinder 74 is retracted to return the pouring unit 12 to the upright position. Next, the oil pressure is introduced into the cylinder bores 64 of the block 52 to protrude the docking rams 66. As a result, the block 52 is raised to insert the sleeve 54 into the biscuit portion 30 of the molding unit 10.

Then, the oil pressure is introduced into the head-end side of the injection cylinder 50 to raise the piston 60. As a result, the plunger tip 70 is raised to introduce the molten metal reserved in the sleeve 54 into the cavity 26 through the biscuit portion 30 and the runner 28.

After the cavity 26 is fully charged up with the molten metal, the feeding rod 42 is projected into the path 28 through the groove portion 300 between the stationary mold 16 and the plunger tip 70 so that the pressure from the feeding rod 42 is wholly transmitted to the cavity 26 whereby a reliable pouring effect can be attained.

After the solidification of the molten metal in the cavity has ended, the movable board 18 is retracted to open the mold, and the cost product is pushed out by a pushing device (although not shown) which is carried on the movable mold 20.

Incidentally, prior to this mold opening step, the piston 60, the block 52 and so on are dropped to their lower limits and prepared for the subsequent casting process.

In the embodiments aforementioned, the mold disclosed is of the transverse clamping type, and the pouring unit disclosed is of the vertical casting type. Despite of this fact, however, the present invention can apparently be applied to an injection molding machine having various molds and pouring unit.

Figure 7:
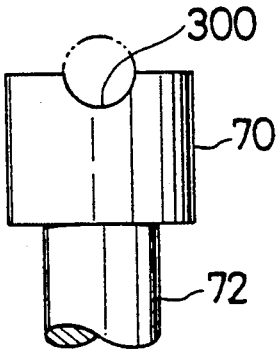
FIGS. 7, 8, 9 and 10 are side views of a plunger tip.
Figure 8:
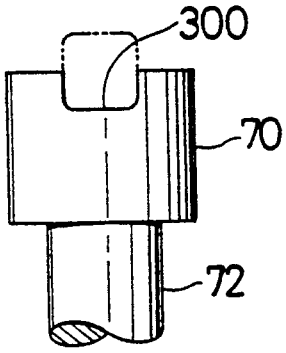
Figure 9:
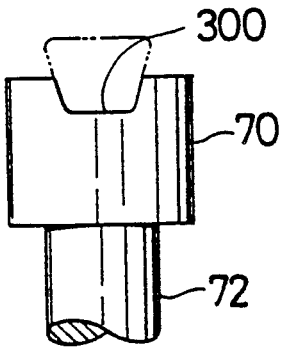
Figure 10:
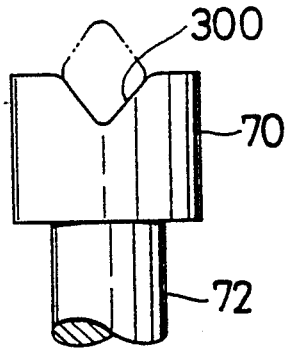

The shape of the groove formed on the top of the plunger tip may be changed into other shape shown in FIG. 7 such as shown in FIG. 8, 9 or 10. The shape of the groove formed on the stationary mold may be changed likely.

What is claimed is:

1. A pressing mechanism for a die casting apparatus comprising:

a mold including a cavity for solidifying molten metal therein and a passage for introducing the molten metal into said cavity;

means for supplying molten metal into said passage, said means having a sleeve to store molten metal and capable of communicating with the passage and a plunger tip in said sleeve, said plunger tip being capable of protruding from said sleeve so that the molten metal is fed into the mold after said sleeve is placed in communication with said passage, said plunger tip being capable of protruding substantially completely into the passage so that a front end of the plunger tip approaches closely to a part of an internal surface of said passage;

a feeding rod disposed in said mold for freely protruding into said passage;

means for reciprocating said feeding rod; and first and second grooves, the first groove being provided on said part of the internal surface of said passage, the second groove being provided on said front end of the plunger tip so that the first and second grooves form a hole through which said feeding rod is protruded to compress the molten metal in the cavity after the mold is filled with the molten metal.

2. A pressing mechanism of a die casting apparatus according to claim 1, wherein said feeding rod is cylindrical and said grooves are semicircular in their cross sections.

3. A pressing mechanism of a die casting apparatus according to claim 1, wherein said means for reciprocating said feeding rod is a hydraulic cylinder.

4. A pressing mechanism of a die casting apparatus according to claim 1, wherein said mold includes a stationary mold portion and a movable mold portion adapted to be coupled to said stationary mold portion, wherein said stationary mold portion and said movable mold portion define said cavity and said passage inbetween the mold portions when they are coupled to each other.

5. A pressing mechanism of a die casting apparatus according to claim 4, wherein said feeding rod is disposed in said stationary mold portion.

* * * * *